US007946766B2

(12) United States Patent
Dais et al.

(10) Patent No.: US 7,946,766 B2
(45) Date of Patent: May 24, 2011

(54) OFFSET CLOSURE MECHANISM FOR A RECLOSABLE POUCH

(75) Inventors: Brian C. Dais, Saginaw, MI (US); Robert R. Turvey, Sanford, MI (US); James C. Pawloski, Bay City, MI (US); Bryan L. Ackerman, Freeland, MI (US); Daniel P. Zimmerman, Livonia, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 1012 days.

(21) Appl. No.: 11/818,586

(22) Filed: Jun. 15, 2007

(65) Prior Publication Data

US 2008/0310771 A1 Dec. 18, 2008

(51) Int. Cl.
*B65D 33/16* (2006.01)
*B65D 33/01* (2006.01)
*A44B 19/00* (2006.01)

(52) U.S. Cl. ..... 383/59; 383/63; 383/100; 24/585.12

(58) Field of Classification Search ..... 383/59, 383/63, 92, 100, 103; 24/585.12
See application file for complete search history.

(56) References Cited

U.S. PATENT DOCUMENTS

| | | | |
|---|---|---|---|
| 2,576,322 | A | 11/1951 | Waters |
| 2,609,314 | A | 9/1952 | Engel et al. |
| 2,633,442 | A | 3/1953 | Caldwell |
| 2,642,372 | A | 6/1953 | Chittick |
| 2,670,501 | A | 3/1954 | Michiels |
| 2,759,866 | A | 8/1956 | Seymour |
| 2,772,712 | A | 12/1956 | Post |
| 2,776,452 | A | 1/1957 | Chavannes |
| 2,778,171 | A | 1/1957 | Taunton |
| 2,778,173 | A | 1/1957 | Taunton |
| 2,821,338 | A | 1/1958 | Metzger |
| 2,856,323 | A | 10/1958 | Gordon |
| 2,858,247 | A | 10/1958 | De Swart |
| 2,870,954 | A | 1/1959 | Kulesza |
| 2,913,030 | A | 11/1959 | Fisher |
| 2,916,411 | A | 12/1959 | Villoresi |
| 2,927,722 | A | 3/1960 | Metzger |
| 2,960,144 | A | 11/1960 | Graf |
| 3,026,231 | A | 3/1962 | Chavannes |
| 3,060,985 | A | 10/1962 | Vance et al. |
| 3,077,428 | A | 2/1963 | Heuser et al. |
| 3,098,563 | A | 7/1963 | Skees |
| 3,102,676 | A | 9/1963 | Danelli et al. |
| 3,113,715 | A | 12/1963 | Pangrac |
| 3,141,221 | A | 7/1964 | Faulls, Jr. |
| 3,142,599 | A | 7/1964 | Chavannes |
| 3,149,772 | A | 9/1964 | Olsson |
| 3,160,323 | A | 12/1964 | Weisberg |

(Continued)

FOREIGN PATENT DOCUMENTS

| | | |
|---|---|---|
| CA | 1315746 | 4/1993 |

(Continued)

*Primary Examiner* — Jes F Pascua

(57) ABSTRACT

An offset resealable closure mechanism adapted to provide an airtight seal for a pouch includes a first elongate closure element and a second elongate closure element. The first elongate closure element includes a first elongate closure profile extending therefrom and a second elongate closure element includes first and second legs extending therefrom to define a channel. A sealing flange extends across the channel and includes a slit therethrough adapted to receive the first elongate closure profile. The sealing flange forms an airtight seal with the first elongate closure profile when the closure mechanism is occluded.

17 Claims, 4 Drawing Sheets

U.S. PATENT DOCUMENTS

| | | | | |
|---|---|---|---|---|
| 3,164,186 | A * | 1/1965 | Weber et al. | 141/390 |
| 3,216,172 | A | 11/1965 | Piazze | |
| 3,219,084 | A | 11/1965 | Ausnit et al. | |
| 3,224,574 | A | 12/1965 | McConnell | |
| 3,237,844 | A | 3/1966 | Hughes | |
| 3,251,463 | A | 5/1966 | Bodet | |
| 3,302,859 | A | 2/1967 | Perry | |
| 3,325,084 | A | 6/1967 | Ausnit | |
| 3,372,442 | A | 3/1968 | Ishimatsu | |
| 3,381,887 | A | 5/1968 | Lowry | |
| 3,389,733 | A | 6/1968 | Siegel | |
| 3,411,698 | A | 11/1968 | Reynolds | |
| 3,423,231 | A | 1/1969 | Lutzmann | |
| 3,440,696 | A | 4/1969 | Staller | |
| 3,464,094 | A | 9/1969 | Mates | |
| 3,516,217 | A | 6/1970 | Gildersleeve | |
| 3,557,413 | A | 1/1971 | Engle | |
| 3,565,147 | A | 2/1971 | Ausnit | |
| 3,575,781 | A | 4/1971 | Pezely | |
| 3,595,467 | A | 7/1971 | Goglio | |
| 3,595,722 | A | 7/1971 | Dawbarn | |
| 3,595,740 | A | 7/1971 | Gerow | |
| 3,600,267 | A | 8/1971 | McFedries, Jr. et al. | |
| 3,608,439 | A | 9/1971 | Ausnit | |
| 3,628,720 | A | 12/1971 | Schmedding | |
| 3,633,642 | A | 1/1972 | Siegel | |
| 3,655,501 | A | 4/1972 | Tesch | |
| 3,661,677 | A | 5/1972 | Wang | |
| 3,679,511 | A | 7/1972 | Ausnit | |
| 3,746,215 | A | 7/1973 | Ausnit et al. | |
| 3,762,404 | A | 10/1973 | Sakita | |
| 3,780,781 | A | 12/1973 | Uramoto | |
| 3,790,992 | A | 2/1974 | Herz | |
| 3,799,427 | A | 3/1974 | Goglio | |
| 3,809,217 | A | 5/1974 | Harrison | |
| 3,833,166 | A | 9/1974 | Murray | |
| 3,908,070 | A | 9/1975 | Marzolf | |
| 3,918,131 | A | 11/1975 | Ausnit | |
| 3,937,396 | A | 2/1976 | Schneider | |
| 3,980,226 | A | 9/1976 | Franz | |
| 3,989,182 | A | 11/1976 | Stearley | |
| 4,000,846 | A | 1/1977 | Gilbert | |
| 4,020,884 | A | 5/1977 | Jadot | |
| 4,085,886 | A | 4/1978 | Nishioka | |
| 4,101,355 | A | 7/1978 | Ausnit | |
| 4,104,404 | A | 8/1978 | Bieler et al. | |
| 4,105,491 | A | 8/1978 | Haase et al. | |
| 4,122,993 | A | 10/1978 | Glas | |
| 4,134,535 | A | 1/1979 | Barthels et al. | |
| 4,155,453 | A | 5/1979 | Ono | |
| 4,186,786 | A | 2/1980 | Kirkpatrick | |
| 4,206,870 | A | 6/1980 | DeVries | |
| 4,212,337 | A | 7/1980 | Kamp | |
| 4,215,725 | A | 8/1980 | Callet et al. | |
| 4,246,288 | A | 1/1981 | Sanborn, Jr. | |
| 4,267,960 | A | 5/1981 | Lind et al. | |
| 4,310,118 | A | 1/1982 | Kisida et al. | |
| 4,332,344 | A | 6/1982 | Strodthoff | |
| 4,340,558 | A | 7/1982 | Hendrickson | |
| 4,354,541 | A | 10/1982 | Tilman | |
| 4,355,494 | A | 10/1982 | Tilman | |
| 4,363,345 | A | 12/1982 | Scheibner | |
| 4,364,989 | A | 12/1982 | Moyle | |
| 4,370,187 | A | 1/1983 | Katagiri et al. | |
| 4,372,921 | A | 2/1983 | Sanderson et al. | |
| 4,426,816 | A | 1/1984 | Dean et al. | |
| 4,430,070 | A | 2/1984 | Ausnit | |
| 4,449,243 | A | 5/1984 | Platel | |
| 4,470,153 | A | 9/1984 | Kenan | |
| 4,491,959 | A | 1/1985 | Loefberg | |
| 4,509,642 | A | 4/1985 | Rowell | |
| 4,524,460 | A | 6/1985 | Twiehoff et al. | |
| 4,528,224 | A | 7/1985 | Ausnit | |
| 4,532,652 | A | 7/1985 | Herrington | |
| 4,541,117 | A | 9/1985 | Ashbeck | |
| 4,550,546 | A | 11/1985 | Raley et al. | |
| 4,551,379 | A | 11/1985 | Kerr | |
| 4,566,131 | A | 1/1986 | Achelpohl | |
| 4,569,712 | A | 2/1986 | Shibano et al. | |
| 4,576,283 | A | 3/1986 | Fafournoux | |
| 4,576,285 | A | 3/1986 | Goglio | |
| 4,578,813 | A | 3/1986 | Ausnit | |
| 4,579,784 | A | 4/1986 | Lemstra et al. | |
| 4,581,764 | A | 4/1986 | Plock et al. | |
| 4,612,221 | A | 9/1986 | Biel et al. | |
| 4,653,661 | A | 3/1987 | Buchner et al. | |
| 4,658,434 | A | 4/1987 | Murray | |
| 4,660,355 | A | 4/1987 | Kristen | |
| 4,672,684 | A | 6/1987 | Barnes et al. | |
| 4,683,702 | A | 8/1987 | Vis | |
| 4,691,372 | A | 9/1987 | Van Erden | |
| 4,691,373 | A | 9/1987 | Ausnit | |
| 4,701,358 | A | 10/1987 | Behr et al. | |
| 4,702,376 | A | 10/1987 | Pagliaro | |
| 4,705,174 | A | 11/1987 | Goglio | |
| 4,712,574 | A | 12/1987 | Perrott | |
| 4,715,494 | A | 12/1987 | Heitzenröder et al. | |
| 4,730,635 | A | 3/1988 | Linden | |
| 4,731,911 | A | 3/1988 | Gould | |
| 4,736,450 | A | 4/1988 | Van Erden et al. | |
| 4,736,451 | A | 4/1988 | Ausnit | |
| 4,747,702 | A | 5/1988 | Scheibner | |
| 4,752,992 | A | 6/1988 | Kondo et al. | |
| 4,756,628 | A | 7/1988 | Branson | |
| 4,756,629 | A | 7/1988 | Tilman et al. | |
| 4,778,282 | A | 10/1988 | Borchardt et al. | |
| 4,780,937 | A | 11/1988 | Kusayama | |
| 4,782,951 | A | 11/1988 | Griesbach et al. | |
| 4,784,885 | A | 11/1988 | Carespodi | |
| 4,787,754 | A | 11/1988 | Herrington | |
| 4,787,755 | A | 11/1988 | Branson | |
| 4,787,880 | A | 11/1988 | Ausnit | |
| 4,791,710 | A | 12/1988 | Nocek et al. | |
| 4,792,240 | A | 12/1988 | Ausnit | |
| 4,795,269 | A | 1/1989 | Scheibner | |
| 4,796,300 | A | 1/1989 | Branson | |
| 4,807,300 | A | 2/1989 | Ausnit et al. | |
| 4,812,056 | A | 3/1989 | Zieke | |
| 4,812,074 | A | 3/1989 | Ausnit et al. | |
| 4,817,188 | A | 3/1989 | Van Erden | |
| 4,825,514 | A | 5/1989 | Akeno | |
| 4,829,641 | A | 5/1989 | Williams | |
| 4,832,505 | A | 5/1989 | Ausnit et al. | |
| 4,834,554 | A | 5/1989 | Stetler, Jr. et al. | |
| 4,840,611 | A | 6/1989 | Van Erden et al. | |
| 4,841,603 | A | 6/1989 | Ragni | |
| 4,858,286 | A | 8/1989 | Siegel | |
| 4,859,259 | A | 8/1989 | Scheibner | |
| 4,863,286 | A | 9/1989 | Branson | |
| 4,869,725 | A | 9/1989 | Schneider et al. | |
| 4,875,259 | A | 10/1989 | Appeldorn | |
| 4,877,334 | A | 10/1989 | Cope | |
| 4,878,763 | A | 11/1989 | Ausnit | |
| 4,890,637 | A | 1/1990 | Lamparter | |
| 4,890,935 | A | 1/1990 | Ausnit et al. | |
| 4,892,414 | A | 1/1990 | Ausnit | |
| 4,903,718 | A | 2/1990 | Sullivan | |
| 4,907,321 | A | 3/1990 | Williams | |
| 4,909,017 | A | 3/1990 | McMahon et al. | |
| 4,911,960 | A | 3/1990 | Mudge et al. | |
| 4,923,701 | A | 5/1990 | VanErden | |
| 4,925,318 | A | 5/1990 | Sorensen | |
| 4,928,829 | A | 5/1990 | Di Bernardo | |
| 4,929,487 | A | 5/1990 | Tilman et al. | |
| 4,930,904 | A | 6/1990 | Gröner et al. | |
| 4,937,139 | A | 6/1990 | Genske et al. | |
| 4,947,525 | A | 8/1990 | Van Erden | |
| 4,953,708 | A | 9/1990 | Beer et al. | |
| 4,961,944 | A | 10/1990 | Matoba et al. | |
| 4,964,739 | A | 10/1990 | Branson et al. | |
| 4,965,108 | A | 10/1990 | Biel et al. | |
| 4,966,470 | A | 10/1990 | Thompson et al. | |
| 4,971,845 | A | 11/1990 | Aaker et al. | |
| 4,985,192 | A | 1/1991 | Roeder et al. | |
| 5,007,143 | A | 4/1991 | Herrington | |
| 5,007,146 | A * | 4/1991 | Meidan | 24/683 |
| 5,009,318 | A | 4/1991 | Lepinoy | |

5,012,561 A 5/1991 Porchia et al.
5,017,021 A 5/1991 Simonsen et al.
5,022,530 A 6/1991 Zieke
RE33,674 E 8/1991 Uramoto
5,037,138 A 8/1991 McClintock et al.
5,041,316 A 8/1991 Parnell et al.
5,044,774 A 9/1991 Bullard et al.
5,053,091 A 10/1991 Giljam et al.
5,056,933 A 10/1991 Kamp
5,059,036 A 10/1991 Richison et al.
5,067,208 A 11/1991 Herrington, Jr. et al.
5,067,822 A 11/1991 Wirth et al.
5,069,962 A 12/1991 Okazaki et al.
5,070,584 A 12/1991 Dais et al.
5,088,162 A 2/1992 Allan
5,088,971 A 2/1992 Herrington
5,092,684 A 3/1992 Weeks
5,093,164 A 3/1992 Bauer et al.
5,093,188 A 3/1992 Dohrer
5,119,531 A 6/1992 Berger et al.
5,120,586 A 6/1992 Nedzu et al.
5,134,001 A 7/1992 Osgood
5,140,727 A 8/1992 Dais et al.
5,140,796 A 8/1992 Pope
5,141,577 A 8/1992 Porchia et al.
5,142,970 A 9/1992 ErkenBrack
5,167,454 A 12/1992 Woods et al.
5,168,586 A 12/1992 Small
5,170,990 A 12/1992 Kamiya et al.
5,174,658 A 12/1992 Cook et al.
5,177,332 A 1/1993 Fong
5,179,767 A 1/1993 Allan
5,186,543 A 2/1993 Cochran
5,188,461 A 2/1993 Sorensen
5,189,764 A 3/1993 Herrington et al.
5,192,135 A 3/1993 Woods et al.
5,198,055 A 3/1993 Wirth et al.
5,203,458 A 4/1993 Cornwell
5,208,096 A 5/1993 Dohrer
5,209,264 A 5/1993 Koyanagi
5,209,574 A 5/1993 Tilman
5,209,972 A 5/1993 Super et al.
5,211,481 A 5/1993 Tilman
5,212,855 A 5/1993 McGanty
5,216,787 A 6/1993 Custer et al.
5,228,271 A 7/1993 Wallace
5,235,731 A 8/1993 Anzai et al.
5,236,749 A 8/1993 Ewing
5,238,306 A 8/1993 Heintz et al.
5,240,112 A 8/1993 Newburger
5,242,516 A 9/1993 Custer et al.
5,242,757 A 9/1993 Buisine et al.
5,246,114 A 9/1993 Underwood
5,248,201 A 9/1993 Kettner et al.
5,252,281 A 10/1993 Kettner et al.
5,252,379 A 10/1993 Kuribayashi et al.
5,254,073 A 10/1993 Richison et al.
5,263,777 A 11/1993 Domke
RE34,477 E 12/1993 Cornwell
5,272,794 A 12/1993 Hamatani et al.
5,283,932 A 2/1994 Richardson et al.
RE34,554 E 3/1994 Ausnit
5,293,672 A 3/1994 Tominaga et al.
5,300,354 A 4/1994 Harita et al.
5,301,394 A 4/1994 Richardson et al.
5,301,395 A 4/1994 Richardson et al.
5,308,666 A 5/1994 Borchardt
5,320,889 A 6/1994 Bettle, III
5,324,572 A 6/1994 Kuechler et al.
5,326,176 A 7/1994 Domke
5,332,095 A 7/1994 Wu
5,333,736 A 8/1994 Kawamura
5,339,602 A 8/1994 Landers et al.
5,339,959 A 8/1994 Cornwell
5,342,684 A 8/1994 Carespodi
5,346,312 A 9/1994 Mabry et al.
5,351,369 A 10/1994 Swain
5,351,828 A 10/1994 Becker et al.
5,354,133 A 10/1994 Rapparini
5,356,222 A 10/1994 Kettner et al.
5,360,670 A 11/1994 Yonezu et al.
5,362,351 A 11/1994 Karszes
5,366,294 A 11/1994 Wirth et al.
5,368,394 A 11/1994 Scott et al.
5,369,847 A 12/1994 Naya et al.
5,371,925 A 12/1994 Sawatsky
5,376,392 A 12/1994 Ikegami et al.
5,382,470 A 1/1995 Vicik
5,384,942 A 1/1995 Siegel
5,388,910 A 2/1995 Koyanagi
5,397,182 A 3/1995 Gaible et al.
5,399,022 A 3/1995 Sheets
5,403,094 A 4/1995 Tomic
5,407,087 A 4/1995 Giblin et al.
RE34,929 E 5/1995 Kristen
5,415,904 A 5/1995 Takubo et al.
5,417,035 A 5/1995 English
5,417,495 A 5/1995 Branson
5,419,638 A 5/1995 Jamison
5,435,864 A 7/1995 Machacek et al.
5,443,851 A 8/1995 Christie et al.
5,445,870 A 8/1995 Buchner et al.
5,448,807 A 9/1995 Herrington, Jr.
5,450,963 A 9/1995 Carson
5,456,979 A 10/1995 Schirmer
5,462,473 A 10/1995 Sheller
5,469,966 A 11/1995 Boyer
5,474,818 A 12/1995 Ulrich et al.
5,480,030 A 1/1996 Sweeney et al.
5,492,241 A 2/1996 Barnett et al.
5,494,165 A 2/1996 Detrick
5,509,734 A 4/1996 Ausnit
5,511,884 A 4/1996 Bruno et al.
5,520,463 A 5/1996 Tilman
5,523,236 A 6/1996 Nuzzo
5,525,363 A 6/1996 Herber et al.
5,526,843 A 6/1996 Wolf et al.
5,540,500 A 7/1996 Tanaka
5,540,557 A 7/1996 Carson
5,542,902 A 8/1996 Richison et al.
5,544,752 A 8/1996 Cox
5,545,419 A 8/1996 Brady et al.
5,549,944 A 8/1996 Abate
5,551,127 A 9/1996 May
5,553,942 A 9/1996 Domke et al.
5,554,423 A 9/1996 Abate
5,558,439 A 9/1996 Tilman
5,558,613 A 9/1996 Tilman et al.
5,566,429 A 10/1996 Martinez et al.
5,567,533 A 10/1996 Toney et al.
5,573,614 A 11/1996 Tilman et al.
5,577,305 A 11/1996 Johnson
5,584,409 A 12/1996 Chemberlen
5,587,192 A 12/1996 Beizermann
5,588,187 A 12/1996 Swain
5,592,697 A 1/1997 Young
5,603,995 A 2/1997 Takubo et al.
5,609,420 A 3/1997 Palmisano
5,618,111 A 4/1997 Porchia et al.
5,622,431 A 4/1997 Simonsen
5,628,566 A 5/1997 Schreiter
5,638,971 A 6/1997 Justesen
RE35,567 E 7/1997 Newsome
5,653,251 A 8/1997 Handler
5,655,273 A 8/1997 Tomic et al.
5,655,842 A 8/1997 Hagino
5,660,479 A 8/1997 May et al.
5,664,303 A 9/1997 Johnson
5,669,715 A 9/1997 Dobreski et al.
5,672,009 A 9/1997 Malin
5,689,866 A 11/1997 Kasai et al.
5,693,283 A 12/1997 Fehn
5,699,838 A 12/1997 Catallo et al.
5,700,091 A 12/1997 Tanaka et al.
5,701,996 A 12/1997 Goto et al.
5,709,479 A 1/1998 Bell
5,709,915 A 1/1998 Tomic et al.
5,713,669 A 2/1998 Thomas et al.

5,718,024 A 2/1998 Robbins
5,729,876 A 3/1998 Johnson
5,730,919 A 3/1998 Wilfong et al.
5,733,619 A 3/1998 Patel et al.
5,735,317 A 4/1998 Wu
5,735,395 A 4/1998 Lo
5,749,493 A 5/1998 Boone et al.
5,749,658 A 5/1998 Kettner
5,753,895 A 5/1998 Olson et al.
5,769,772 A 6/1998 Wiley
5,770,287 A 6/1998 Miranda et al.
5,774,954 A 7/1998 Ramsey et al.
5,775,812 A 7/1998 St. Phillips et al.
5,782,562 A 7/1998 Anspacher
5,782,733 A 7/1998 Yeager
5,784,862 A 7/1998 Germano
5,786,010 A 7/1998 Yannuzzi, Jr.
5,791,783 A 8/1998 Porchia et al.
5,794,315 A 8/1998 Crabtree et al.
5,804,265 A 9/1998 Saad et al.
5,827,163 A 10/1998 Kettner
5,829,884 A 11/1998 Yeager
5,830,545 A 11/1998 Frisk
5,833,791 A 11/1998 Bryniarski et al.
5,839,582 A 11/1998 Strong et al.
5,839,831 A 11/1998 Mazzocchi
5,839,832 A 11/1998 Hagino
5,843,578 A 12/1998 Sasaki et al.
5,855,498 A 1/1999 Spector
5,871,281 A 2/1999 Stolmeier et al.
5,871,790 A 2/1999 Monier et al.
5,874,155 A 2/1999 Gehrke et al.
5,875,611 A 3/1999 Plourde
5,881,881 A 3/1999 Carrington
5,882,120 A 3/1999 Bell
5,893,461 A 4/1999 Walters
5,893,645 A 4/1999 May
5,894,929 A 4/1999 Kai et al.
5,898,113 A 4/1999 Vecere
5,902,046 A 5/1999 Shibata
5,902,047 A 5/1999 Yeager
5,911,508 A 6/1999 Dobreski et al.
5,915,596 A 6/1999 Credle, Jr.
5,919,535 A 7/1999 Dobreski et al.
5,919,547 A 7/1999 Kocher et al.
5,924,173 A 7/1999 Dobreski et al.
5,924,795 A 7/1999 Thompson et al.
5,927,336 A 7/1999 Tanaka et al.
5,927,855 A 7/1999 Tomic et al.
5,928,762 A 7/1999 Aizawa et al.
5,930,877 A 8/1999 Thorpe et al.
5,931,189 A 8/1999 Sweeney et al.
5,931,582 A 8/1999 Nichols
5,933,927 A 8/1999 Miller et al.
5,941,421 A 8/1999 Overman et al.
5,941,643 A 8/1999 Linkiewicz
5,944,425 A 8/1999 Forman
5,947,603 A 9/1999 Tilman
5,951,453 A 9/1999 Yeager
5,953,796 A 9/1999 McMahon et al.
5,954,196 A 9/1999 Lin
5,954,433 A 9/1999 Yeager
5,956,815 A 9/1999 O'Connor et al.
5,964,532 A 10/1999 St. Phillips et al.
5,965,224 A 10/1999 Chen et al.
5,967,664 A 10/1999 Giles et al.
5,971,613 A 10/1999 Bell
5,981,028 A 11/1999 Sugawa et al.
5,983,466 A 11/1999 Petkovsek
5,985,391 A 11/1999 Denehy et al.
5,988,426 A 11/1999 Stern
5,988,880 A 11/1999 Tomic
5,989,608 A 11/1999 Mizuno
5,992,442 A 11/1999 Urquhart et al.
5,992,635 A 11/1999 Walters
5,996,800 A 12/1999 Pratt
6,004,032 A 12/1999 Kapperman et al.
6,009,603 A 1/2000 Gallagher
6,010,244 A 1/2000 Dobreski et al.
6,012,264 A 1/2000 Linkiewicz
6,014,795 A 1/2000 McMahon et al.
6,017,412 A 1/2000 Van Erden et al.
6,019,512 A 2/2000 Yeager
6,021,624 A 2/2000 Richison et al.
6,023,914 A 2/2000 Richison et al.
6,029,810 A 2/2000 Chen
6,030,122 A 2/2000 Ramsey et al.
6,033,113 A 3/2000 Anderson
6,033,114 A 3/2000 Grimm et al.
6,039,182 A 3/2000 Light
6,044,621 A 4/2000 Malin et al.
6,045,264 A 4/2000 Miniea
6,045,546 A 4/2000 Drago et al.
6,045,648 A 4/2000 Palmgren et al.
6,047,450 A 4/2000 Machacek et al.
6,056,439 A 5/2000 Graham
6,059,456 A 5/2000 May
6,059,457 A 5/2000 Spreche et al.
6,068,898 A 5/2000 Oyama
6,070,397 A 6/2000 Bachhuber
6,070,728 A 6/2000 Overby et al.
6,071,011 A 6/2000 Thomas et al.
6,071,626 A 6/2000 Frisk
6,074,096 A 6/2000 Tilman
6,076,967 A 6/2000 Beaudette
6,077,578 A 6/2000 Valyi
6,080,252 A 6/2000 Plourde
6,082,897 A 7/2000 Galomb
6,083,584 A 7/2000 Smith et al.
6,085,906 A 7/2000 Lambert
6,085,922 A 7/2000 Esser
6,092,931 A 7/2000 Tilman
6,103,050 A 8/2000 Krueger
6,110,586 A 8/2000 Johnson
6,112,374 A 9/2000 Van Erden
6,116,781 A 9/2000 Skeens
6,117,505 A 9/2000 Weiss et al.
6,120,817 A 9/2000 Archibald et al.
6,126,013 A 10/2000 Miller
6,126,975 A 10/2000 Archibald et al.
6,132,089 A 10/2000 Galomb et al.
6,138,329 A 10/2000 Johnson
6,146,764 A 11/2000 Suokas et al.
6,148,588 A 11/2000 Thomas et al.
6,149,302 A 11/2000 Taheri
6,149,304 A 11/2000 Hamilton et al.
6,152,601 A 11/2000 Johnson
6,156,363 A 12/2000 Chen et al.
6,164,825 A 12/2000 Larkin et al.
6,167,597 B1 1/2001 Malin
6,170,985 B1 1/2001 Shabram, Jr. et al.
6,176,613 B1 1/2001 Chen
6,177,172 B1 1/2001 Yeager
6,178,602 B1 1/2001 Burke et al.
6,182,337 B1 2/2001 Machacek et al.
6,182,850 B1 2/2001 Marbler et al.
6,185,796 B1 2/2001 Ausnit
6,194,011 B1 2/2001 Glaser
6,194,043 B1 2/2001 Fehn
6,202,849 B1 3/2001 Graham
6,203,867 B1 3/2001 Derkach et al.
6,203,915 B1 3/2001 Prissok et al.
6,209,287 B1 4/2001 Thieman
6,217,216 B1 4/2001 Taheri
6,218,024 B1 4/2001 Tamber et al.
6,220,754 B1 4/2001 Stiglic et al.
6,224,262 B1 5/2001 Hogan et al.
6,227,706 B1 5/2001 Tran
6,231,236 B1 5/2001 Tilman
6,231,975 B1 5/2001 Kong et al.
6,240,941 B1 6/2001 Small et al.
6,244,021 B1 6/2001 Ausnit et al.
6,244,748 B1 6/2001 Kasai et al.
6,248,442 B1 6/2001 Kong et al.
6,257,763 B1 7/2001 Stolmeier et al.
6,270,257 B1 8/2001 Yeager
6,270,950 B1 8/2001 Bourdelais et al.
6,273,609 B1 8/2001 Johnson 6,274,181 B1 8/2001 Richison et al.
6,279,298 B1 8/2001 Thomas et al.
6,279,745 B1 8/2001 Huynen et al.
6,286,191 B2 9/2001 Van Erden
6,286,999 B1 9/2001 Cappel et al.
6,287,001 B1 9/2001 Buchman
6,289,561 B1 9/2001 Provan et al.
6,290,391 B1 9/2001 Buchman
6,290,392 B1 9/2001 Sandor
6,292,986 B1 9/2001 Provan et al.
6,293,701 B1 9/2001 Tomic
6,294,264 B1 9/2001 Piper et al.
6,299,353 B1 10/2001 Piechocki et al.
6,299,720 B1 10/2001 Van Erden
6,303,199 B1 10/2001 Takada et al.
6,306,472 B1 10/2001 Buelow
6,316,114 B1 11/2001 Comer et al.
6,317,939 B1 11/2001 Malin
6,321,423 B1 11/2001 Johnson
6,334,711 B1 1/2002 Risgalla et al.
6,344,258 B1 2/2002 Rasmussen
6,345,911 B1 2/2002 Young et al.
6,347,437 B2 2/2002 Provan et al.
6,354,738 B1 3/2002 Buckman et al.
6,355,336 B1 3/2002 Wakabayashi et al.
6,357,915 B2 3/2002 Anderson
6,361,209 B1 3/2002 LaRue et al.
6,361,211 B1 3/2002 Tilman
6,361,212 B1 3/2002 Sprehe et al.
6,361,843 B1 3/2002 Smith et al.
6,364,530 B1 4/2002 Buchman
6,371,643 B2 4/2002 Saad et al.
6,371,644 B1 4/2002 Forman
6,372,359 B1 4/2002 Hayashi et al.
6,374,855 B1 4/2002 Hansen
6,376,035 B1 4/2002 Dobreski et al.
6,378,272 B1 4/2002 Archibald et al.
6,385,818 B1 5/2002 Savicki, Sr.
6,386,760 B1 5/2002 Tomic
6,390,676 B1 5/2002 Colombo et al.
6,391,404 B1 5/2002 Rosenbaum et al.
6,402,375 B1 6/2002 Schreiter et al.
6,403,174 B1 6/2002 Copeta
6,408,872 B1 6/2002 Skeens et al.
6,413,597 B1 7/2002 Hirai
6,439,771 B1 8/2002 Herrington, Jr.
6,450,686 B1 9/2002 May
6,451,426 B2 9/2002 Kong et al.
6,461,042 B1 10/2002 Tomic et al.
6,468,332 B2 10/2002 Goglio et al.
6,479,115 B2 11/2002 Fehn
6,481,889 B2 11/2002 Delsahut
6,481,890 B1 11/2002 VandenHeuvel
6,487,758 B2 12/2002 Shaffer et al.
6,489,022 B1 12/2002 Hamilton et al.
6,491,166 B1 12/2002 Compton et al.
6,491,433 B2 12/2002 Shabram, Jr. et al.
6,499,878 B1 12/2002 Dobreski et al.
6,499,879 B2 12/2002 Schneck
6,500,505 B2 12/2002 Piper et al.
6,503,588 B1 1/2003 Hayashi et al.
6,505,383 B2 1/2003 Machacek et al.
6,506,464 B1 1/2003 Montenieri et al.
6,513,659 B1 2/2003 Ogura et al.
6,517,242 B1 2/2003 Buchman
6,521,312 B1 2/2003 Keiser
6,524,002 B2 2/2003 Tomic
6,526,632 B1 3/2003 Blythe et al.
6,527,003 B1 3/2003 Webster
6,530,870 B2 3/2003 Buchman et al.
6,533,456 B1 3/2003 Buchman
D473,761 S 4/2003 Wilk et al.
6,539,594 B1 4/2003 Kasai et al.
6,550,965 B2 4/2003 Shaffer et al.
6,568,046 B1 5/2003 Savicki et al.
6,571,430 B1 6/2003 Savicki et al.
6,572,267 B1 6/2003 Forman
6,575,191 B2 6/2003 Skeens et al.
6,576,329 B2 6/2003 Kong
6,576,348 B2 6/2003 Eggers et al.
6,579,584 B1 6/2003 Compton
6,579,621 B1 6/2003 Shah
6,581,253 B2 6/2003 ErkenBrack
6,581,641 B2 6/2003 Skeens et al.
6,595,689 B1 7/2003 Borchardt et al.
D478,774 S 8/2003 Wilk et al.
6,602,580 B1 8/2003 Hamilton et al.
6,602,590 B2 8/2003 Ting et al.
6,604,634 B2 8/2003 Su
6,609,353 B1 8/2003 McMahon et al.
6,609,827 B2 8/2003 Bois et al.
6,611,996 B2 9/2003 Blythe et al.
6,620,474 B1 9/2003 Regnier et al.
6,622,857 B2 9/2003 Ohtsubo et al.
6,623,866 B2 9/2003 Migliorini et al.
6,632,021 B2 10/2003 Bois et al.
6,634,384 B2 10/2003 Skeens et al.
6,637,939 B2 10/2003 Huffer
6,656,548 B1 12/2003 Beckwith et al.
6,659,643 B2 12/2003 Plourde et al.
6,662,827 B1 12/2003 Clougherty et al.
6,663,284 B2 12/2003 Buckingham et al.
6,663,947 B2 12/2003 Freedman et al.
6,666,580 B2 12/2003 Bois
6,667,083 B2 12/2003 Hayashi et al.
6,675,982 B2 1/2004 Heil et al.
6,679,027 B2 1/2004 Schreiter
6,680,104 B2 1/2004 Boris et al.
6,682,792 B2 1/2004 Schmal et al.
6,691,383 B2 2/2004 Linton
6,692,147 B2 2/2004 Nelson
6,694,704 B1 2/2004 Ausnit
6,698,925 B2 3/2004 Bentsen
6,706,377 B2 3/2004 Peet
6,712,334 B2 3/2004 Motonaka et al.
6,712,509 B2 3/2004 Cappel
6,713,152 B2 3/2004 Chen et al.
6,715,644 B2 4/2004 Wilford
6,721,999 B2 4/2004 Meager
6,729,473 B2 5/2004 Anderson
6,739,755 B2 5/2004 Schreiter
6,753,370 B2 6/2004 Nakatsukasa et al.
6,755,568 B2 6/2004 Malone et al.
6,767,131 B2 7/2004 Taheri
6,773,163 B2 8/2004 Ichikawa et al.
6,777,089 B1 8/2004 Königer et al.
6,780,146 B2 8/2004 Thomas et al.
6,786,641 B2 9/2004 Plourde
6,789,690 B2 9/2004 Nieh et al.
6,789,946 B2 * 9/2004 Plourde et al. ..... 383/63
6,794,021 B2 9/2004 Bader
6,796,933 B2 9/2004 Bois
6,799,680 B2 10/2004 Mak
6,799,890 B2 10/2004 Schneider et al.
6,810,642 B2 11/2004 Cortigiano, Sr.
6,817,763 B2 11/2004 Tomic
6,821,589 B2 11/2004 Dobreski et al.
6,824,885 B2 11/2004 Fitch et al.
6,826,808 B2 12/2004 Kutschka
6,827,105 B1 12/2004 Marble et al.
6,827,492 B2 12/2004 Cook
6,830,377 B2 12/2004 Schneider
6,833,170 B1 12/2004 Knoerzer et al.
6,835,257 B2 12/2004 Perrine
6,837,268 B2 1/2005 Skeens et al.
6,845,598 B1 1/2005 Melchoir
6,846,107 B2 1/2005 Sweeney et al.
6,846,532 B1 1/2005 Bensur
6,846,551 B2 1/2005 Genske et al.
RE38,694 E 2/2005 Nelson
6,851,248 B2 2/2005 Knight et al.
6,854,886 B2 2/2005 Piechocki et al.
6,862,980 B2 3/2005 Heil et al.
6,872,458 B1 3/2005 Rudd et al.
6,874,935 B2 4/2005 Edelman et al.
6,874,937 B2 4/2005 Ausnit
6,874,938 B2 4/2005 Price et al.
6,877,898 B2 4/2005 Berich et al.

6,883,665 B1 4/2005 Ahn
6,884,207 B2 4/2005 Pokusa
6,884,483 B2 4/2005 Hayashi et al.
6,901,637 B2 6/2005 Machacek
6,902,795 B1 6/2005 Ishii et al.
6,910,805 B2 6/2005 Johnson
6,910,806 B2 6/2005 Strand et al.
6,913,387 B2 7/2005 Strand et al.
6,925,688 B1 8/2005 Savicki
6,932,509 B2 8/2005 Shah et al.
6,939,597 B2 9/2005 Winget et al.
6,945,392 B2 9/2005 Furukawa et al.
6,946,176 B2 9/2005 Jousse et al.
6,954,969 B1 10/2005 Sprehe
6,955,465 B2 10/2005 Machacek et al.
6,957,915 B2 10/2005 Tankersley
6,960,374 B1 11/2005 Terada et al.
6,964,519 B2 11/2005 ErkenBrack
6,974,256 B2 12/2005 Kinigakis et al.
6,976,669 B2 12/2005 Van Zijll Langhout et al.
6,979,495 B2 12/2005 Keung et al.
6,983,845 B2 1/2006 Shah et al.
6,984,278 B2 1/2006 Anderson et al.
6,988,828 B2 1/2006 Linneweil
6,991,109 B1 1/2006 Shannon et al.
6,993,886 B2 2/2006 Johnson
6,996,879 B1 2/2006 Savicki
7,001,659 B2 2/2006 Iriyama
7,004,209 B2 2/2006 Davis et al.
7,004,632 B2 2/2006 Hamilton et al.
7,011,615 B2 3/2006 Price et al.
7,022,058 B2 4/2006 Lee
7,026,417 B2 4/2006 Yang et al.
7,036,988 B2 5/2006 Olechowski
7,048,136 B2 5/2006 Havens et al.
7,051,762 B2 5/2006 Haamer
7,077,570 B2 7/2006 Fukumori et al.
7,077,923 B2 7/2006 Lin
7,087,130 B2 8/2006 Wu et al.
7,087,277 B2 8/2006 Yang et al.
7,090,397 B2 8/2006 Stolmeier
7,090,398 B2 8/2006 Shibata
7,096,893 B2 8/2006 Vilalta et al.
7,097,359 B2 8/2006 Plourde et al.
7,108,147 B2 9/2006 Cheung
7,131,550 B2 11/2006 Vilalta et al.
7,138,025 B2 11/2006 Wu et al.
7,144,615 B2 12/2006 Peiffer et al.
7,157,126 B2 1/2007 Cosentino et al.
7,159,282 B2 * 1/2007 Blythe et al. ..... 24/400
7,162,779 B2 1/2007 MacHacek
7,163,338 B2 1/2007 McCracken et al.
7,178,555 B2 2/2007 Engel et al.
7,244,223 B2 7/2007 Hartman et al.
7,437,805 B2 * 10/2008 Berich ..... 24/399
2001/0012550 A1 8/2001 Fehn
2001/0031371 A1 10/2001 Kong et al.
2001/0034999 A1 11/2001 Xiong et al.
2001/0038897 A1 11/2001 Curie et al.
2002/0012803 A1 1/2002 Kending
2002/0022144 A1 2/2002 Yang et al.
2002/0041964 A1 4/2002 Winget et al.
2002/0090151 A1 7/2002 Skeens et al.
2002/0097923 A1 7/2002 Dobreski et al.
2002/0124471 A1 9/2002 Anderson et al.
2002/0146551 A1 10/2002 Freedman et al.
2002/0160167 A1 10/2002 Bader
2002/0168118 A1 11/2002 Price
2002/0168119 A1 11/2002 Herrington, Jr.
2002/0168489 A1 11/2002 Ting et al.
2002/0168512 A1 11/2002 Eggers et al.
2002/0182390 A1 12/2002 Migliorini et al.
2002/0187326 A1 12/2002 Kong
2003/0012901 A1 1/2003 Bezek et al.
2003/0016887 A1 1/2003 Su
2003/0021925 A1 1/2003 Schmal et al.
2003/0024847 A1 2/2003 Malaspina
2003/0031387 A1 2/2003 Gipson et al.
2003/0053722 A1 3/2003 Eggermont
2003/0077008 A1 * 4/2003 Plourde et al. ..... 383/63
2003/0095727 A1 5/2003 Leighton
2003/0102245 A1 6/2003 Wang
2003/0116466 A1 6/2003 Goto
2003/0118253 A1 6/2003 Machacek
2003/0136798 A1 7/2003 Wilford
2003/0169948 A1 9/2003 Fenzl et al.
2003/0175457 A1 9/2003 Jousse et al.
2003/0194154 A1 * 10/2003 Machacek et al. ..... 383/63
2003/0207061 A1 11/2003 Hayashi et al.
2003/0217444 A1 * 11/2003 Blythe et al. ..... 24/399
2003/0219174 A1 11/2003 Piechocki
2003/0219177 A1 11/2003 Salvaro
2003/0219557 A1 11/2003 Denehy et al.
2003/0223654 A1 12/2003 Gerrits
2003/0235669 A1 12/2003 Yang et al.
2004/0000336 A1 1/2004 Goglio
2004/0000503 A1 1/2004 Shah et al.
2004/0001651 A1 1/2004 Pawloski
2004/0007494 A1 1/2004 Popeil et al.
2004/0014579 A1 1/2004 Sweeney et al.
2004/0022457 A1 2/2004 Brown et al.
2004/0028856 A1 2/2004 Smith et al.
2004/0040961 A1 3/2004 Vilalta et al.
2004/0049896 A1 3/2004 Savicki
2004/0050745 A1 3/2004 Lee et al.
2004/0057636 A1 3/2004 Ishizaki
2004/0058178 A1 3/2004 Yang et al.
2004/0078939 A1 4/2004 Pawloski
2004/0081375 A1 4/2004 Pokusa
2004/0091185 A1 5/2004 Shibata
2004/0091186 A1 5/2004 Shibata
2004/0098845 A1 5/2004 Fukumori et al.
2004/0105600 A1 6/2004 Floyd, Jr.
2004/0114837 A1 6/2004 Koyanagi
2004/0136617 A1 7/2004 Gerrits
2004/0136618 A1 7/2004 Ausnit et al.
2004/0136622 A1 7/2004 Shigeta et al.
2004/0165794 A1 8/2004 Plourde et al.
2004/0177595 A1 9/2004 Kozak
2004/0191438 A1 9/2004 Cosentino et al.
2004/0208400 A1 10/2004 Linneweil
2004/0211698 A1 10/2004 John Mak
2004/0213967 A1 10/2004 Peiffer et al.
2004/0223667 A1 11/2004 Shah et al.
2004/0234170 A1 11/2004 Pawloski et al.
2004/0252915 A1 12/2004 Nelson
2004/0256050 A1 12/2004 Wu
2005/0008266 A1 1/2005 Crunkleton et al.
2005/0014011 A1 1/2005 Oya
2005/0022472 A1 2/2005 Brakes et al.
2005/0025394 A1 2/2005 Kinigakis et al.
2005/0029704 A1 2/2005 Wu et al.
2005/0034425 A1 2/2005 Johnson
2005/0034806 A1 2/2005 Wu et al.
2005/0034807 A1 2/2005 Wu et al.
2005/0035020 A1 2/2005 Wu et al.
2005/0036717 A1 2/2005 Wu et al.
2005/0036718 A1 2/2005 Wu et al.
2005/0036719 A1 2/2005 Wu et al.
2005/0037164 A1 2/2005 Wu et al.
2005/0042441 A1 2/2005 Peiffer et al.
2005/0042468 A1 2/2005 Peiffer et al.
2005/0061812 A1 3/2005 Vilalta et al.
2005/0063620 A1 3/2005 Anderson
2005/0065007 A1 3/2005 Wu et al.
2005/0069229 A1 3/2005 McCracken et al.
2005/0103798 A1 5/2005 Luigi
2005/0123748 A1 6/2005 Paris
2005/0135710 A1 6/2005 Melchoir
2005/0147330 A1 7/2005 Lee
2005/0172577 A1 8/2005 Oltrogge
2005/0190995 A1 9/2005 Koyanagi
2005/0196076 A1 9/2005 Tanaka et al.
2005/0205455 A1 9/2005 Harrison
2005/0208282 A1 9/2005 Woods, Jr. et al.
2005/0220373 A1 10/2005 Wu
2005/0220374 A1 10/2005 Thomas et al.
2005/0220376 A1 10/2005 Tsukanome et al.

| | | | |
|---|---|---|---|
| 2005/0229365 | A1 | 10/2005 | Offa-Jones |
| 2005/0235468 | A1 | 10/2005 | Borchardt et al. |
| 2005/0238263 | A1 | 10/2005 | Ping |
| 2005/0244083 | A1 | 11/2005 | McMahon et al. |
| 2005/0245376 | A1 | 11/2005 | Savicki et al. |
| 2005/0251973 | A1 | 11/2005 | Sprehe |
| 2005/0259895 | A1 | 11/2005 | Kozak |
| 2005/0271308 | A1 | 12/2005 | Pawloski |
| 2005/0276524 | A1 | 12/2005 | Taheri |
| 2005/0281489 | A1 | 12/2005 | Yeh et al. |
| 2005/0281490 | A1 | 12/2005 | Schneider et al. |
| 2005/0281493 | A1 | 12/2005 | Heinemeier et al. |
| 2005/0281494 | A1 | 12/2005 | Allen et al. |
| 2005/0282695 | A1 | 12/2005 | Yeager |
| 2005/0286808 | A1 | 12/2005 | Zimmerman et al. |
| 2005/0286810 | A1 | 12/2005 | Sprague et al. |
| 2005/0286811 | A1 | 12/2005 | Sprague et al. |
| 2005/0286812 | A1 | 12/2005 | Sprague et al. |
| 2005/0286813 | A1 | 12/2005 | Borchardt |
| 2005/0286817 | A1 | 12/2005 | Hall et al. |
| 2006/0008185 | A1 | 1/2006 | Borchardt |
| 2006/0008187 | A1 | 1/2006 | Armstrong |
| 2006/0013514 | A1 | 1/2006 | Wu |
| 2006/0029299 | A1 | 2/2006 | Share et al. |
| 2006/0030472 | A1 | 2/2006 | Hartman et al. |
| 2006/0034551 | A1 | 2/2006 | Linneweil |
| 2006/0035046 | A1 | 2/2006 | Lee |
| 2006/0035777 | A1 | 2/2006 | Johnson |
| 2006/0048483 | A1 | 3/2006 | Tilman et al. |
| 2006/0050999 | A1 | 3/2006 | Blythe et al. |
| 2006/0053749 | A1 | 3/2006 | Scanlan |
| 2006/0072860 | A1 | 4/2006 | Wu |
| 2006/0073291 | A1 | 4/2006 | Wu |
| 2006/0076058 | A1 | 4/2006 | Rypstra |
| 2006/0093242 | A1 | 5/2006 | Anzini et al. |
| 2006/0104548 | A1 | 5/2006 | Schreiter |
| 2006/0105166 | A1 | 5/2006 | Lischefski et al. |
| 2006/0110079 | A1 | 5/2006 | Zimmerman et al. |
| 2006/0111226 | A1 | 5/2006 | Anzini et al. |
| 2006/0120632 | A1 | 6/2006 | Han |
| 2006/0120633 | A1 | 6/2006 | Goldenberg et al. |
| 2006/0131328 | A1 | 6/2006 | Anderson |
| 2006/0157140 | A1 | 7/2006 | Bergman et al. |
| 2006/0159372 | A1 | 7/2006 | Plourde et al. |
| 2006/0159576 | A1 | 7/2006 | Bergman et al. |
| 2006/0165316 | A1 | 7/2006 | Cheung |
| 2006/0172137 | A1 | 8/2006 | Champion |
| 2006/0177156 | A1 | 8/2006 | Owen et al. |
| 2006/0179620 | A1 | 8/2006 | MacHacek |
| 2006/0182371 | A1 | 8/2006 | Borchardt |
| 2006/0193540 | A1 | 8/2006 | Borchardt |
| 2006/0201576 | A1 | 9/2006 | Domenig |
| 2006/0225787 | A1 | 10/2006 | Newrones et al. |
| 2006/0228057 | A1 | 10/2006 | Newrones et al. |
| 2006/0251841 | A1 | 11/2006 | Yang et al. |
| 2006/0263497 | A1 | 11/2006 | Hoffman |
| 2006/0283148 | A1 | 12/2006 | Zimmermann et al. |
| 2006/0292322 | A1 | 12/2006 | Nakajima et al. |
| 2007/0090109 | A1 | 4/2007 | Gustavsson |
| 2007/0130733 | A1 | 6/2007 | Kasai |
| 2007/0154118 | A1 | 7/2007 | Tilman et al. |
| 2007/0172157 | A1 | 7/2007 | Buchman |
| 2007/0232473 | A1 | 10/2007 | Hartman et al. |

FOREIGN PATENT DOCUMENTS

| | | |
|---|---|---|
| DE | 1 901 372 U | 9/1964 |
| DE | 1 290 073 | 2/1969 |
| DE | 1 486 280 | 4/1969 |
| DE | 1 486 733 | 6/1969 |
| DE | 1 411 644 | 7/1969 |
| DE | 23 31 862 | 1/1975 |
| DE | 24 54 248 | 5/1976 |
| DE | 27 47 071 | 4/1979 |
| DE | 28 48 835 | 5/1980 |
| DE | 33 12 887 | 10/1984 |
| DE | 34 11 371 | 10/1985 |
| DE | 35 21 373 | 12/1986 |
| DE | 93 00 361 | 1/1994 |
| DE | 43 05 065 | 8/1994 |
| DE | 198 43 430 | 2/2000 |
| EP | 144 011 | 6/1985 |
| EP | 149 695 | 7/1985 |
| EP | 373 833 | 6/1990 |
| EP | 450 741 | 10/1991 |
| EP | 505 057 | 9/1992 |
| EP | 633 193 | 1/1995 |
| EP | 729 901 | 9/1996 |
| EP | 767 105 | 4/1997 |
| EP | 808 776 | 11/1997 |
| EP | 1 231 155 | 8/2002 |
| EP | 1 407 681 | 4/2004 |
| FR | 2 353 452 | 6/1976 |
| FR | 2 380 953 | 2/1978 |
| FR | 2 603 164 | 3/1988 |
| FR | 2 695 108 | 3/1994 |
| GB | 154244 | 11/1919 |
| GB | 961222 | 6/1964 |
| GB | 1016476 | 1/1966 |
| GB | 1046963 | 10/1966 |
| GB | 1121514 | 7/1968 |
| GB | 1548244 | 7/1979 |
| GB | 2028081 | 3/1980 |
| GB | 1583503 | 1/1981 |
| GB | 2237553 | 5/1991 |
| JP | 55-090364 | 7/1980 |
| JP | 57-21579 | 2/1982 |
| JP | 61-166960 | 10/1986 |
| JP | 62-99534 | 6/1987 |
| JP | 62-192779 | 8/1987 |
| JP | 63-6278 | 1/1988 |
| JP | 63-6279 | 1/1988 |
| JP | 63-203559 | 8/1988 |
| JP | 1-099925 | 4/1989 |
| JP | 1-279073 | 11/1989 |
| JP | 3-212355 | 9/1991 |
| JP | 4-13543 | 2/1992 |
| JP | 4-13544 | 2/1992 |
| JP | 4-60847 | 5/1992 |
| JP | 5-051039 | 3/1993 |
| JP | 5-124656 | 5/1993 |
| JP | 6-3846 | 1/1994 |
| JP | 6-99991 | 4/1994 |
| JP | 6-329179 | 11/1994 |
| JP | 7-839 | 1/1995 |
| JP | 8-011942 | 1/1996 |
| JP | 8-198274 | 8/1996 |
| JP | 2000-281084 | 10/2000 |
| JP | 2001-173818 | 6/2001 |
| JP | 2001-233383 | 8/2001 |
| JP | 2001-247137 | 9/2001 |
| JP | 2002-193273 | 7/2002 |
| JP | 2002-302164 | 10/2002 |
| JP | 2003-507264 | 2/2003 |
| JP | 2004-123228 | 4/2004 |
| JP | 2004-531435 | 10/2004 |
| JP | 2004-359292 | 12/2004 |
| WO | WO 88/07479 | 10/1988 |
| WO | WO 98/57862 | 12/1998 |
| WO | WO 01/94227 | 12/2001 |
| WO | WO 02/14161 | 2/2002 |
| WO | WO 02/30772 | 4/2002 |
| WO | WO 02/074522 | 9/2002 |
| WO | WO 03/001096 | 1/2003 |
| WO | WO 2004/002840 | 1/2004 |
| WO | WO 2004/002841 | 1/2004 |
| WO | WO 2004/002850 | 1/2004 |
| WO | WO 2004/078590 | 9/2004 |
| WO | WO 2004/078591 | 9/2004 |
| WO | WO 2004/078609 | 9/2004 |
| WO | WO 2004/108556 | 12/2004 |
| WO | WO 2004/108557 | 12/2004 |
| WO | WO 2005/000706 | 1/2005 |
| WO | WO 2005/016774 | 2/2005 |
| WO | WO 2005/040005 | 5/2005 |
| WO | WO 2006/127739 | 11/2006 |
| WO | WO 2007/149656 | 12/2007 |

* cited by examiner

OFFSET CLOSURE MECHANISM FOR A RECLOSABLE POUCH

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates to a resealable closure mechanism, such as may be used on a thermoplastic pouch.

2. Description of the Background of the Invention

Thermoplastic pouches having one or more resealable closure mechanisms extending along an opening into an interior thereof are often used to store perishable contents, such as food. In order to keep the food stored inside the pouch fresh for an extended period, a user may expel excess air out of the pouch before completely sealing the closure mechanism. Some pouches allow a vacuum to be formed inside the pouch and then be sealed so as to vacuum pack the contents of the pouch. Other pouches have been developed that have a separate air evacuation route so that air may be removed from the pouch after the closure mechanism has already been sealed. Sometimes, a resealable closure mechanism is included that has specialized features for providing beneficial sealing characteristics beyond simple interlockability.

For example, one closure mechanism has a male and female closure element attached to inner surfaces of opposing pouch sidewalls, respectively. A frangible diaphragm extends across an opening of the female closure element to prevent complete engagement of the closure elements during manufacture, handling, and stacking.

Another closure mechanism has a gasket flange loosely disposed between opposing first and second closure elements attached to opposing first and second sidewalls, respectively, of a pouch. The gasket flange is attached to one or both of the first and second sidewalls of the pouch on the interior and/or exterior of the profiles and the gasket flange extends into an interior of the pouch. The profiles are interlocked with the gasket flange interposed therebetween to improve the efficacy of the seal therealong.

Yet another closure mechanism has a female profile having a base with a first pouch sidewall extending therefrom. Apertures through the base of the female profile provide communication between a space between first and second female legs that extend from the base and an opposite side of the base so that a male profile inserted into the female profile will urge any particles lodged in the space to pass through the apertures and out of the closure mechanism.

A further closure mechanism has first and second profiles that interlock in a closed state to form a space therebetween extending longitudinally along the length of the zipper. The bases of both zipper profiles are provided with apertures for enabling particulate matter trapped in the space between the profiles to pass through the apertures into the interior volume of the package.

SUMMARY OF THE INVENTION

According to one aspect of the invention, a closure mechanism includes a first base and a second base. An elongate channel is defined by a first leg spaced apart from a second leg, wherein each leg extends from the first base. A respective distal end of each of the first and second legs is attached to an outer surface of a sealing flange that includes a slit therethrough that extends along a length of the channel. An elongate profile extends laterally from the second base, wherein the profile extends through the slit into the channel to releasably engage with the elongate channel when the closure mechanism is in an occluded state.

According to another aspect of the invention, a pouch includes first and second opposing pouch sidewalls attached to one another and defining a mouth between opposing inner surfaces thereof. A first base includes an elongate channel comprising first and second spaced apart legs extending therefrom, wherein a distal end of each of the first and second spaced apart legs is attached to an outer surface of a sealing flange proximate the mouth and the sealing flange includes a slit therethrough that extends along a length of the channel. A second base includes an elongate profile extending therefrom and is attached to an inner surface of the second pouch sidewall opposite the channel. A flange extends angularly from the distal end of the first leg, wherein the flange is sealingly disposed on the first pouch sidewall and the profile extends into the channel through the slit when the elongate channel and the elongate profile are occluded.

According to yet another aspect of the invention, a pouch includes first and second opposing pouch sidewalls attached to one another and defining a mouth between opposing inner surfaces thereof. A first closure element includes an elongate channel having first and second spaced apart legs extending from a first base and an aperture that extends through one of the first and second legs or the first base between the legs. A distal end of each of the first and second legs is attached to an outer surface of a sealing flange proximate the mouth and the sealing flange includes a slit therethrough that extends along a length of the channel. A second closure element comprises an elongate profile that extends from a second base, wherein the second base is attached to an inner surface of the second pouch sidewall opposite the channel. A flange extends angularly from the distal end of the first leg, wherein the flange is sealingly disposed on the first pouch sidewall and air may be evacuated from within the pouch through the aperture.

BRIEF DESCRIPTION OF THE DRAWINGS

Other aspects and advantages of the present invention will become apparent upon consideration of the following detailed description, wherein similar structures have similar reference numerals.

DETAILED DESCRIPTION

Figure 1:
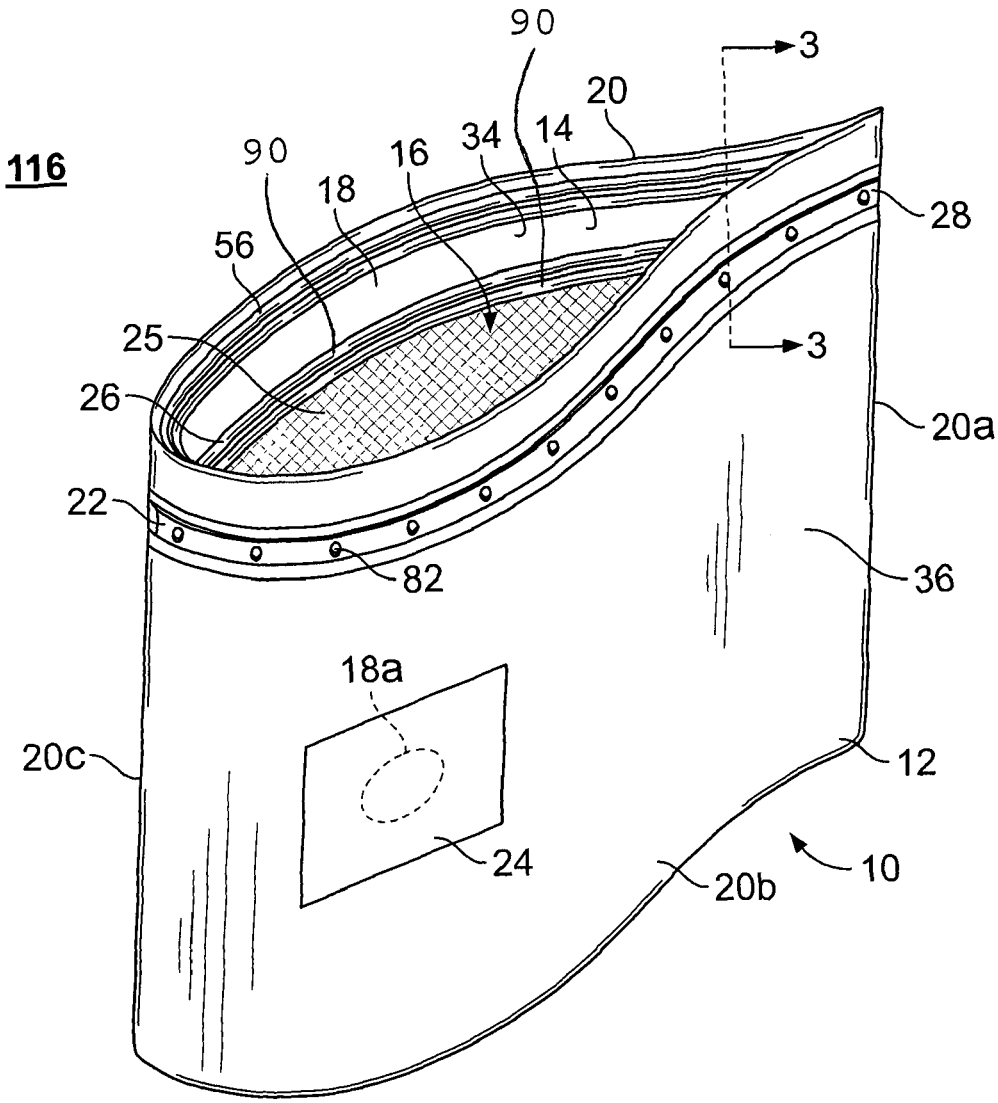
FIG. 1 is an isometric view of a pouch and a closure mechanism according to one embodiment of the present invention.
Figure 2:
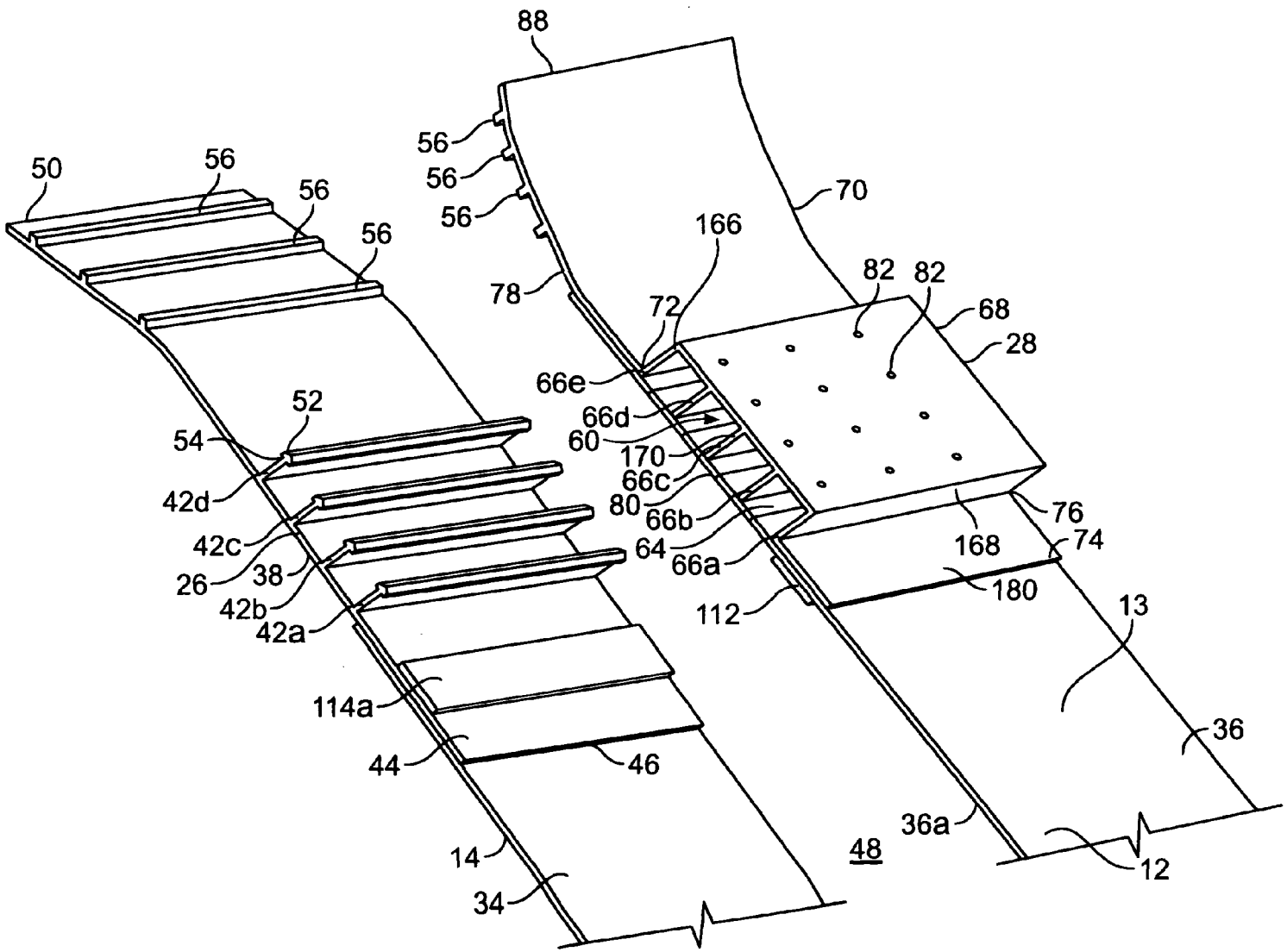
FIG. 2 is a partial isometric cutaway view of one embodiment of an offset closure mechanism that can be used with the pouch of FIG. 1 with first and second closure profiles of the closure mechanism spaced apart.
Figure 3:
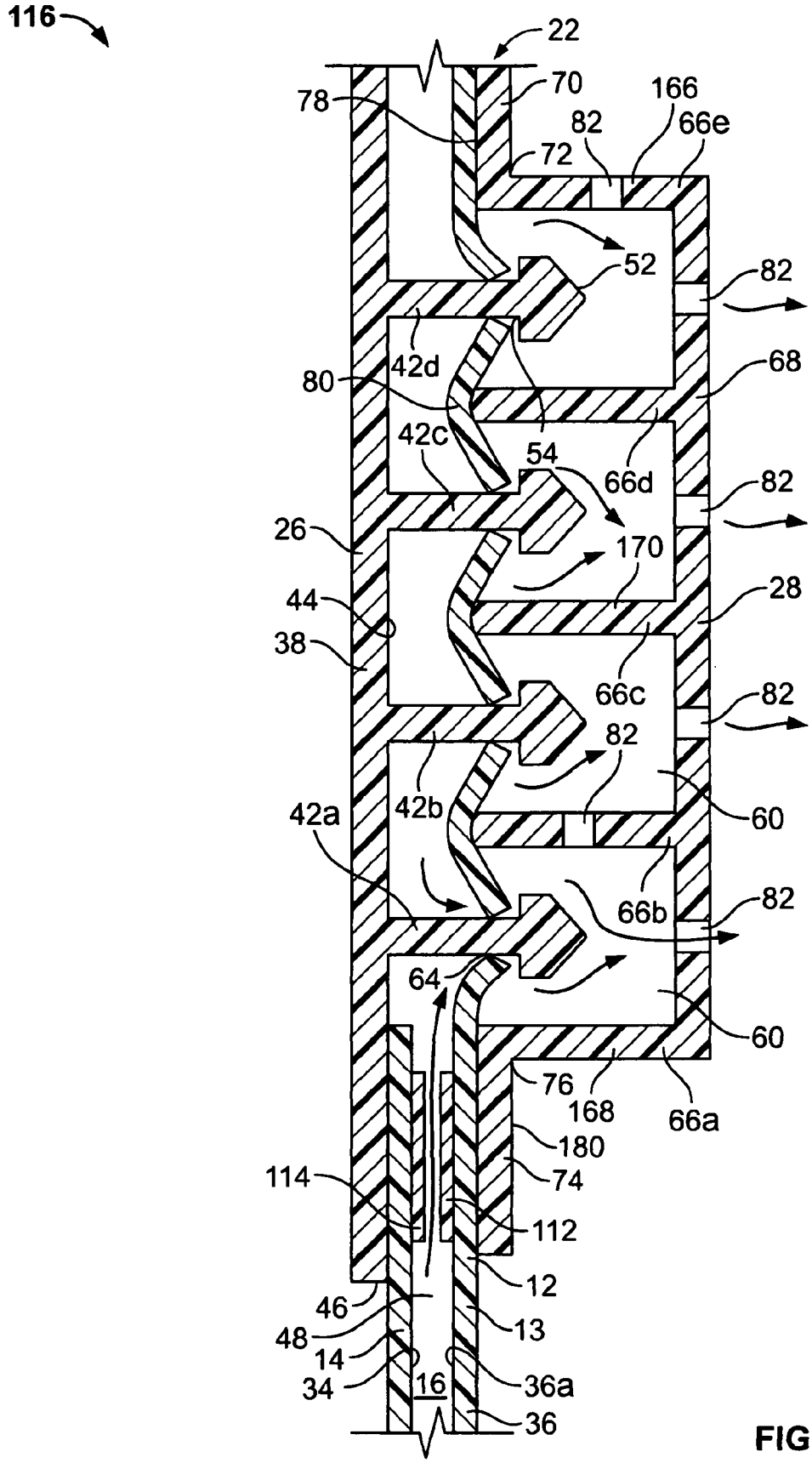
FIG. 3 is a partial cross-sectional view of the offset closure mechanism of FIG. 2 taken along the lines 3-3 of FIG. 1 with the closure profiles interlocked.

FIGS. 1-3 illustrate a resealable pouch 10 having a first sidewall 12 and a second sidewall 14 that are connected by, for example folding, heat sealing, and/or an adhesive, along three peripheral edges 20*a*, 20*b*, and 20*c* to define an interior space 16 therebetween and an opening 18 along a top edge 20 where the first and second sidewalls 12, 14 are not connected so as to allow access to the interior space 16. A resealable elongate closure mechanism 22 along the first and second sidewalls 12, 14 near the opening 18 extends between the peripheral edge 20*a* and the peripheral edge 20*c* of the pouch 10 to allow the opening 18 to be repeatedly occluded and deoccluded, thereby respectively sealing and unsealing the opening.

When occluded, the closure mechanism 22 provides an airtight seal such that a vacuum may be maintained in the pouch interior 16 for a desired period of time, such as days, months, or years, when the closure mechanism is sealed fully across the opening 18. In one embodiment, the pouch 10 may include a second opening 18*a* through one of the sidewalls 12, 14 that is covered by a valve 24, such as a check or one-way valve, to allow air to be evacuated from the pouch interior 16 and maintain a vacuum when the closure mechanism 22 has been sealed. As shown in FIG. 1, the valve 24 may be disposed on the first sidewall 12 spaced from the closure mechanism 22. The valve 24 provides a fluid path with fluid communication between the interior 16 and an exterior 116 of the pouch 10. Illustrative valves useful in the present invention include those disclosed in, for example, Newrones et al. U.S. Patent application publication No. 2006/0228057. Other valves useful in the present invention include those disclosed in, for example, U.S. patent application Ser. Nos. 11/818,592 and 11/818,591, each filed Jun. 15, 2007.

Although not shown, in some embodiments an evacuation pump or device may be used to evacuate fluid from the pouch 10 through, for example, the valve 24 disposed in one of the side walls 12, 14, or in or through the closure mechanism 22 or one of the peripheral edges 20*a*-20*c* of the pouch. Illustrative evacuation pumps or devices useful in the present invention include those disclosed in, for example, U.S. patent application Ser. No. 11/818,703, filed Jun. 15, 2007.

The closure mechanism 22 includes a first closure element 26 that releasably interlocks and seals with an opposing second closure element 28. Each of the closure elements 26, 28 has a substantially constant elongate cross-sectional profile that extends longitudinally between the peripheral edge 20*a* and the peripheral edge 20*c* of the pouch 10 to form a continuous seal therealong when fully interlocked with the opposing closure element. In one embodiment, the first closure element 26 is disposed on an interior surface 34 of the second sidewall 14 and the second closure element 28 is disposed along an exterior surface 36 of the first sidewall 12. In other embodiments, the orientation of the closure elements 26, 28 with respect to the sidewalls 12, 14 may be reversed accordingly.

The pouch 10 may include relief on or along an interior surface of one or both of the first and second sidewalls 12, 14 to provide fluid or air flow channels 25 between the sidewalls 12, 14 when a vacuum, for example, is being drawn through the check valve 24. In this manner, the pouch 10 provides a complete evacuable system within which items, for example food, may be stored. One or both sidewalls, such as the second sidewall 14, may also be embossed or otherwise textured with a pattern, such as a diamond pattern, to provide the air flow channels 25 on one or both surfaces spaced between the bottom edge 20*b* and the closure mechanism 22 and including a smooth area adjacent the bottom edge for attachment of opposing sidewalls 12, 14 and a smooth area adjacent the top edge 20 for attachment of the closure mechanism, or a separate textured and embossed patterned wall may be used to provide additional flow channels (not shown) within the pouch interior 16. Illustrative air flow channels 25 useful in the present invention include those disclosed in Zimmerman et al. U.S. Patent Application Publication No. 2005/0286808 and Tilman et al. U.S. Patent Application Publication No. 2006/0048483. Other air flow channels 25 useful in the present invention include those disclosed in, for example, U.S. patent application Ser. No. 11/818,584, filed Jun. 15, 2007.

As best illustrated in FIGS. 2 and 3, the first closure element 26 includes a base 38 attached to the interior surface 34 of the second sidewall 14 and spaced apart parallel walls, for example, posts 42*a*-42*d*, projecting generally perpendicularly from an interior side 44 of the base 38 away from the second sidewall 14. The posts 42*a*-42*d* are disposed between an inner edge 46 of the base 38 on an interior side 48 of the closure profiles 26, 28 and an outer edge 50 of the base 38 on a user side of the closure elements 26, 28. An arrow-shaped head 52 is disposed at a distal end 54 of each post 42*a*-42*d*. Protuberances, such as ridges 56, are disposed near the outer edge 50 of the base 38 to provide increased traction in a convenient area for a user to grip, such as a gripping flange, when trying to open a sealed pouch.

The second closure element 28 includes spaced apart walls or legs that extend from a base 68 including at least a pair of exterior legs 166 and 168 or, for example, 66*e* and 66*a*, to define a channel 60 therebetween as shown in FIGS. 2 and 3. The second closure element 28 may also include interior legs 170, for example, 66*b*, 66*c*, and 66*d*, that may also define channels 60 therebetween. An upper flange 70 extends generally perpendicularly from a distal end 72 of the exterior leg 166, for example, leg 66*e*, toward the user side of the second closure element 28, and a lower flange 74 extends generally perpendicularly from a distal end 76 of the exterior leg 168, for example, the leg 66*a*, toward the interior side 48 of the closure elements 26, 28. A sealing flange 13, such as the first sidewall 12, is connected to the inner side 78 of the upper and lower flanges 70, 74 and extends across the channels 60, such that the channels 60 are disposed on the exterior side 36 of the first sidewall 12.

In this embodiment, the sealing flange 13 is integral with the first sidewall 12. In other embodiments not shown, the sealing flange 13 may be a distinct member separate from the first sidewall 12, such as a thermoplastic film, including for example a polyolefin plastomer, independently applied across the second closure element 28 and that extends from the upper flange 70 to the lower flange 74. In this embodiment, it is contemplated that the sealing flange 13 may be applied to the second closure element 28 across the channels 60 by a coextrusion process with the second closure element. The closure element 28 is then attached to the outer surface 36 of the first sidewall 12 by, for example, an adhesive. In another embodiment, it is further contemplated that the sealing flange 13 may be independently applied to the second closure element 28 across the channels 60 and that an outer surface 180 of the lower flange 74 may be attached to an inner surface 36*a* of the first sidewall 12.

The sealing flange 13 may include an opening or a slit 64 along each of the channels 60, thereby forming a cantilevered flap 80 extending from each leg 66*a*-66*e*. In one embodiment, each slit 64 extends along the entire length of the channel 60 between the peripheral edges 20*a* and 20*c* of the pouch 10. In other embodiments not shown, the opening or slit 64 may be disposed at selected regions of the second closure element 28, which may correspond, for example, to the air flow channels 25 disposed in the first or second sidewalls 12, 14. The second closure element 28 may also include ridges 56 that are disposed near an exterior edge 88 of the upper flange 70 to provide traction for gripping, thereby forming a gripping flange region.

The cantilevered flaps 80 extend across the channel 60, yet also provide fluid communication through the slits 64 between the channel 60 and the interior space 16 within the pouch. When the closure elements 26 and 28 are urged together into sealed engagement by opposing lateral forces, each post 42*a*-42*d* and arrow-shaped head 52 extends through the corresponding slit 64 into the opposing channel 60, as best seen in FIG. 3, thereby rotating or bending the flaps 80. The cantilevered flaps 80 may sealingly engage each post 42*a*-42*d* to provide an airtight vacuum seal between the posts 42*a*-42*d* and the corresponding flaps 80 and/or releasably engage and/or interlock the first closure element 26 and the second closure element 28.

An illustrative example of the first and second closure elements 26, 28 is described previously herein. However, the configuration and geometry of the first and second closure elements 26, 28 shown herein may vary. In a further embodiment, one or both of the first and second closure elements 26, 28 may include one or more textured portions 90, such as a bump or crosswise groove in one or more of posts 42*a*-42*d* in order to provide a tactile and/or audible sensation, such as a series of clicks, as a user draws the fingers along the closure mechanism 22 to seal the closure elements across the opening 18. Further, in some embodiments, a sealing material such as a polyolefin material or a caulking composition such as silicone grease may be disposed on or in the channels 60, posts 42*a*-42*d*, flaps 80, heads 52, or generally on or in the closure elements 26, 28 to fill in any gaps or spaces therein when occluded. The ends of the channels 60, posts 42*a*-42*d*, or closure elements 26, 28 may also be welded or sealed by ultrasonic vibrations as is known in the art. It is also contemplated that the closure mechanisms 22 described herein may also be used in conjunction with or in addition to other closure profiles and closure elements. Illustrative interlocking profiles, closure elements, sealing materials, tactile or audible closure elements, and/or end seals useful in the present invention include those disclosed in, for example, Pawloski U.S. Pat. No. 4,927,474, Dais et al. U.S. Pat. Nos. 5,070,584, 5,478,228, and 6,021,557, Tomic et al. U.S. Pat. No. 5,655,273, Sprehe U.S. Pat. No. 6,954,969, Kasai et al. U.S. Pat. No. 5,689,866, Ausnit U.S. Pat. No. 6,185,796, Wright et al. U.S. Pat. No. 7,041,249, Pawloski et al. U.S. Pat. No. 7,137,736, Anderson U.S. Patent Application Publication No. 2004/0091179, Pawloski U.S. Patent Application Publication No. 2004/0234172, Tilman et al. U.S. Patent Application Publication No. 2006/0048483, and Anzini et al. U.S. Patent Application Publication Nos. 2006/0093242 and 2006/0111226. Other interlocking profiles and closure elements useful in the present invention include those disclosed in, for example, U.S. patent application Ser. No. 11/725,120, filed Mar. 16, 2007, and U.S. patent application Ser. Nos. 11/818,585 and 11/818,593, each filed Jun. 15, 2007. It is further appreciated that the closure elements 26, 28 disclosed herein may be operated by hand, or a slider (not shown) may be used to assist in occluding and de-occluding the closure elements.

In one embodiment, shown in FIG. 3, attachment of the second closure element 28 to the exterior surface 36 of the first sidewall displaces the closure mechanism 22 such that it is offset from an imaginary centerline between the first and second sidewalls 12, 14. This offset geometry also disposes the closure mechanism 22 outside of the first and second sidewalls 12, 14. In this example, because the first and second sidewalls 12, 14 directly oppose and lie flat on one another at the ends of the closure mechanism 22, the first and second sidewalls may be sealed to one another without excess material of one or both of the closure elements 26, 28 disposed therebetween. The ends of the closure mechanism 22 may be sealed at the peripheral edges 20*a*, 20*c* of the pouch 10, for example, by crushing, heat, and/or ultrasonic sealing. Excess material disposed between the first and second sidewalls 12, 14 may only partially flatten during this sealing process resulting in the formation of crush gaps above and below the excess material, wherein the crush gaps allow leakage through the peripheral edges 20*a*, 20*c* of the pouch 10. The offset geometry of the closure mechanism 22 may eliminate the formation of crush gaps that may occur when the closure mechanism is on the interior surface 36*a*, 34 of one or more of the respective sidewalls 12, 14. The crush gaps may require extra filling material or extra compression force to fill or close. Therefore, end seals may be created using less material, less energy, and less time when the offset geometry closure mechanism 22 is utilized. Further, the sealed engagement of the closure mechanism 22, as shown in FIG. 3, may provide an airtight seal between the closure elements 26, 28 while requiring a relatively low closing force to engage the closure elements.

In the embodiment of FIGS. 2 and 3, one or more apertures 82 extend through the base 68 or one or both of the exterior legs 166, 168 into at least one or, for example, into all of the channels 60, thereby providing fluid communication between the respective channel 60 and the exterior 116 of the pouch 10. An evacuation device (not shown) may be placed over the one or more apertures 82 that extend through the base 68 or one or both of the exterior legs 166, 168 to evacuate the pouch 10. One or more apertures 82 may also extend through one or more of the interior legs 66*b*-66*d* between two of the channels 60, thereby providing fluid communication between the respective channels. Illustratively, a plurality of spaced apart apertures 82 may extend through the base 68 or through the legs 66*a*-66*e* along each channel 60. In an embodiment that includes the plurality of apertures 82 as shown illustratively in FIG. 1, the evacuation device (not shown) may be placed over the plurality of apertures 82 to evacuate the pouch. If any of the apertures 82 through the base 68 or through one or both of the exterior legs 166, 168 are not covered by the evacuation device, the fluid communication provided by the apertures 82 between the channels 60 and the external side of the base 68 prevents the evacuation device from evacuating the pouch 10.

In this embodiment, the flaps 80 may function as a one-way check valve such that positive pressure inside the pouch 10 causes air to evacuate past the flaps 80 and through the apertures 82 to the exterior. For example, positive pressure inside the pouch 10 causes the flaps 80 to rotate or bend away from the posts 42*a*-42*d* and allow air to be expelled through the aperture 82, whereas the flaps 80 seal more tightly against the posts 42*a*-42*d* in response to an inward flow of air, such as would be caused by a negative pressure or vacuum inside the pouch 10. When the closure mechanism 22 is deoccluded, the arrow-head 52 of each post 42 may rotate or bend the respective flaps 80 back to their original position, thereby causing each flap 80 to touch the opposing adjacent flap 80 and potentially slowing the rate at which the flaps 80 might suffer from stress creep over a long period of time.

In other embodiments, different numbers of complementary posts 42*a*-42*d* and corresponding channels 60 may be provided, such as, for example, as few as one post 42*a* and one channel 60 or more than four posts having a like or greater number of opposing complementary channels and slits through the sealing flange 13. Further, various shaped heads, such as hooks, barbs, cross-bars, or simply no apparent head may be attached to the distal end 54 of the various posts 42*a*-42*d* instead of or supplemental to the arrow-shaped heads 52 shown.

Figure 4:
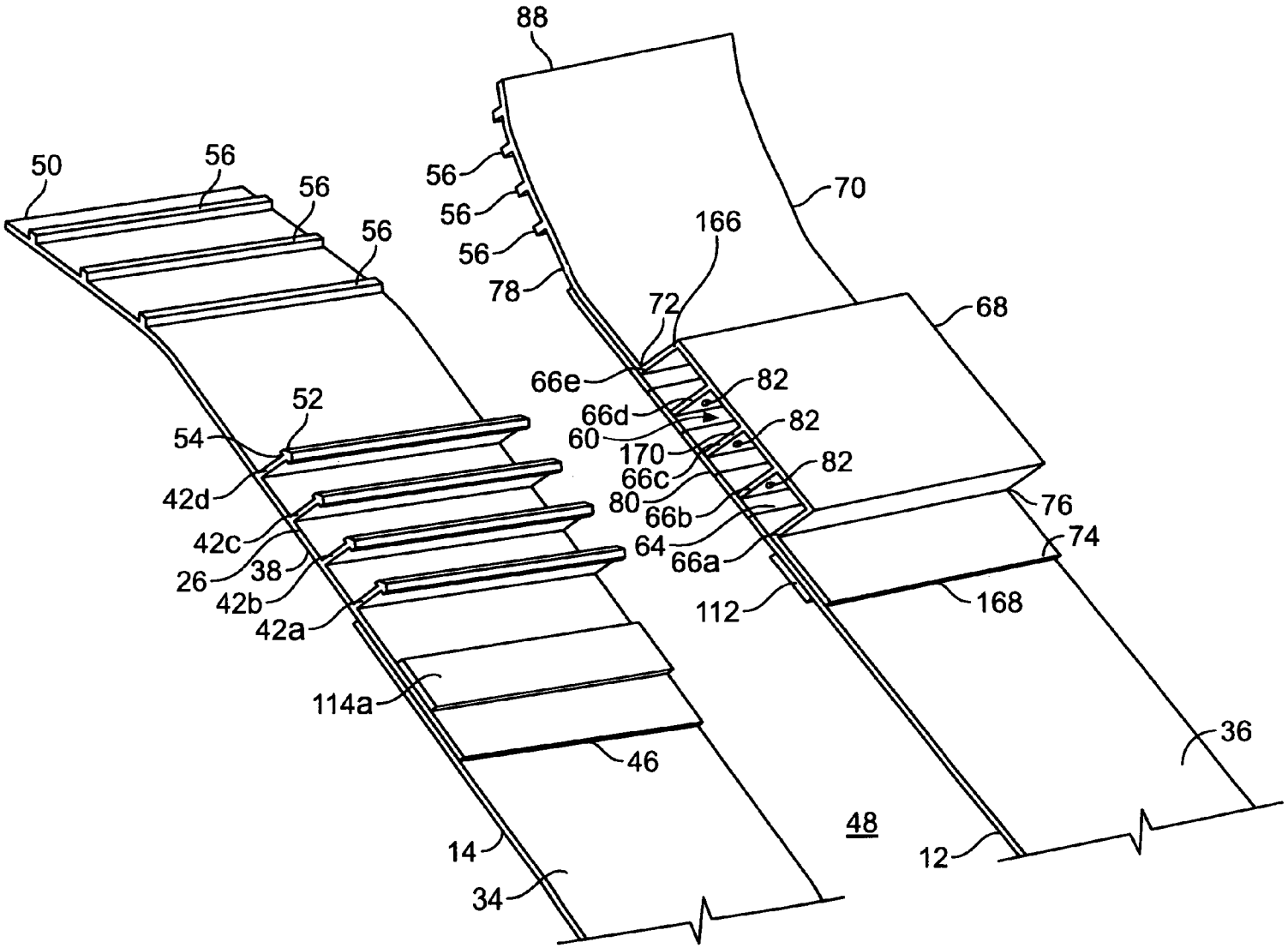
FIG. 4 is a partial isometric cutaway view of another embodiment of an offset closure mechanism that can be used with the pouch of FIG. 1.

The embodiment shown in FIG. 4 is substantially identical to the closure mechanism 22 of FIGS. 2 and 3, with a difference being that the second closure element 28 does not have any apertures 82 through the base 68 or the exterior legs 166, 168. This embodiment may include one or more apertures 82 through one or more of the interior legs 170. In this embodiment, a user may evacuate air from within the pouch 10 through the check valve 24 and the flaps 80 of the sealing flange 13 act as one-way valves in response to both positive and negative pressure inside the pouch. The addition of one or more apertures 82 through one or more of the interior legs 170 may serve to inhibit any pressure imbalances between the channels 60 that may otherwise cause unwanted lateral displacement of the interior legs.

In one embodiment, the first and second sidewalls 12, 14, the sealing flange 13, and/or the closure mechanism 22 are formed from thermoplastic resins by known extrusion methods. For example, the sidewalls 12, 14 and the sealing flange 13 may be independently extruded of thermoplastic material as a single continuous or multi-ply web, and the closure mechanism 22 may be extruded of the same or different thermoplastic material(s) separately as continuous lengths or strands. The first or second sidewall 12, 14 and the sealing flange 13 may then be independently attached to the closure mechanism 22. In other embodiments where the sealing flange 13 is integral with the first or second sidewalls 12, 14, the closure mechanism 22 may be directly applied to the sealing flange and the respective first or second sidewall 12, 14. Illustrative thermoplastic materials include polypropylene (PP), polyethylene (PE), metallocene-polyethylene (mPE), low density polyethylene (LDPE), linear low density polyethylene (LLDPE), ultra low density polyethylene (ULDPE), biaxially-oriented polyethylene terephthalate (BPET), high density polyethylene (HDPE), polyethylene terephthalate (PET), among other polyolefin plastomers and combinations and blends thereof. Further, sealing flange 13, or a portion or area thereof, and/or inner surfaces of the respective sidewalls 12, 14 or a portion or area thereof 112, 114, respectively, or the inner surface 44 of the base 38 or a portion or area thereof 114*a*, may, for example, be composed of a polyolefin plastomer such as an AFFINITY™ resin manufactured by Dow Plastics. The polyolefin plastomer may also be applied as an independent layer (not shown) to, for example, the sealing flange 13 or the first or second sidewalls 12, 14. Such portions or areas include, for example, the area of one or both of the sidewalls 12, 14 proximate and parallel to the closure mechanism 22 to provide an additional cohesive seal between the sidewalls when the pouch 10 is evacuated for the area forming the seal between one or more of the posts 42*a*-42*d* and one of the cantilevered flaps 80, for example.

One or more of the sidewalls 12, 14 in other embodiments may also be formed of air-impermeable film. An example of an air-impermeable film includes a film having one or more barrier layers, such as an ethylene-vinyl alcohol copolymer (EVOH) ply or a nylon ply, disposed between or on one or more of the plies of the sidewalls 12, 14. The barrier layer may be, for example, adhesively secured between the PP and/or LDPE plies to provide a multilayer film. The sealing flange 13 may be made of the same material as the sidewalls 12, 14 or may be made of a material different than the sidewalls. Illustratively, the sealing flange 13 is made substantially of only a polyolefin plastomer such as an AFFINITY™ resin.

Other additives such as colorants, slip agents, and antioxidants, including for example talc, oleamide or hydroxyl hydrocinnamate may also be added as desired. In another embodiment, the closure mechanism 22 may be extruded primarily of molten PE with various amounts of slip component, colorant, and talc additives in a separate process. The fully formed closure mechanism 22 may be attached to the pouch body using a strip of molten thermoplastic weld material, or by an adhesive known by those skilled in the art, for example. Other thermoplastic resins and air-impermeable films useful in the present invention include those disclosed in, for example, Tilman et al. U.S. Patent application publication No 2006/0048483.

The resealable pouch described herein can be made by various techniques known to those skilled in the art including those described in, for example, Geiger, et al., U.S. Pat. No. 4,755,248. Other useful techniques to make a resealable pouch include those described in, for example, Zieke et al., U.S. Pat. No. 4,741,789. Additional techniques to make a resealable pouch include those described in, for example, Porchia et al., U.S. Pat. No. 5,012,561. Additional examples of making a resealable pouch as described herein include, for example, a cast post applied process, a cast integral process, and/or a blown process.

The fully formed closure elements 26, 28 may be attached along opposite edges of one side of the web by placing or extruding a strip of molten thermoplastic weld material onto the web along or adjacent to each edge of the web and immediately placing a closure element 26, 28 onto each strip of molten thermoplastic weld material. The thermoplastic weld material may then allowed to cool, the web folded together between the opposite edges to place the closure elements 26, 28 in opposing resealable relation, and the web severed transverse to the web direction into discrete pouches, in a manner well known in the art, to form the pouch 10. According to another embodiment, the web, intermediate layer of connecting material, and the closure elements 26, 28 may be extruded together simultaneously, and subsequently cooled, folded, and cut. If used, the check valve 24 may be formed on and/or attached to the web prior to folding or after folding.

Various details shown in FIGS. 1-4 may be modified as will be apparent to those of skill in the art without departing from the disclosed principles. For example, the orientation of the closure elements 26, 28 with respect to the interior space 16 may be altered from the orientation shown in the figures, such that, for example, the closure element 26 may be disposed on an exterior surface of the second sidewall 14 and the closure element 28 may be disposed on an interior surface of the first sidewall 12. Other methods and materials suitable for forming structures of the present invention may also be utilized.

INDUSTRIAL APPLICABILITY

A closure mechanism according the present disclosure may be useful for sealing reclosable openings, such as the mouth of a thermoplastic pouch. Further, the closure mechanisms of the present disclosure may provide an improved airtight seal suitable for maintaining a vacuum inside an airtight pouch. Some closure mechanisms of the present disclosure may also be useful for providing a convenient evacuation check valve integrated with the closure mechanism. Clearly the closure mechanisms and pouches of the present disclosure may also have many other possible uses, and the present disclosure is not limited to the few specific uses enumerated herein.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive right to all modifications within the scope of the impending claims is expressly reserved. All patents, patent publications and applications, and other references cited herein are incorporated by reference herein in their entirety.

We claim:

1. A closure mechanism, comprising:

a first base and a second base;

an elongate channel defined by a first leg spaced apart from a second leg, each leg extending from the first base and having a respective distal end;

a sealing flange attached to and extending from the respective distal ends of each of the first and second legs, the sealing flange includes a slit therethrough that extends along a length of the channel between the first leg and the second leg; and an elongate profile that extends laterally from the second base, wherein the profile extends through the slit into the channel to releasably engage with the elongate channel when the closure mechanism is in an occluded state, wherein the sealing flange forms a seal against the elongate profile, wherein at least one of the first base the first leg or the second leg includes an aperture therethrough, and wherein the sealing flange is integral to a first pouch sidewall.

2. The closure mechanism of claim 1, wherein the sealing flange comprises a polyolefin plastomer.

3. The closure mechanism of claim 1, wherein the elongate profile includes a post and an arrow-shaped head disposed at a distal end of the post, and a textured portion along the length of the elongate profile to provide tactile and/or audible sensations when the closure mechanism is occluded.

4. A closure mechanism, comprising:

a first base and a second base;

an elongate channel defined by a first leg spaced apart from a second leg, each leg extending from the first base and having a respective distal end;

a sealing flange attached to and extending from the respective distal ends of each of the first and second legs, the sealing flange includes a slit therethrough that extends along a length of the channel between the first leg and the second leg; and an elongate profile that extends laterally from the second base, wherein the profile extends through the slit into the channel to releasably engage with the elongate channel when the closure mechanism is in an occluded state;

wherein a plurality of elongate channels is each defined by first and second spaced apart legs, each of the first and second legs extending from the first base, a respective distal end of each of the first and second legs is attached to the sealing flange that includes a plurality of slits therethrough, wherein each of the plurality of slits extends along each of the plurality of channels, and each of a plurality of profiles laterally extends from the second base through each slit into each of the corresponding plurality of channels to releasably engage with each of the corresponding plurality of elongate channels when the closure mechanism is in an occluded state, and wherein an interior leg includes an aperture therethrough.

5. The closure mechanism of claim 4, wherein the sealing flange forms a seal against the elongate profile.

6. The closure mechanism of claim 5, wherein at least one of the first base the first leg or the second leg includes an aperture therethrough.

7. The closure mechanism of claim 6, wherein the sealing flange is integral to a first pouch sidewall.

8. The closure mechanism of claim 4, wherein the first base or an exterior leg includes an aperture that extends between the channel and an exterior environment.

9. A pouch, comprising:

first and second pouch sidewalls, each having respective outer and inner surfaces and attached to one another to define a mouth between the respective inner surfaces thereof;

a closure element attached to the first pouch sidewall and having an upper flange and a lower flange and an elongate channel comprising first and second legs extending from a first base with each leg having a respective distal end;

a sealing flange attached to and extending from the upper flange and the lower flange, the sealing flange having a slit therethrough that extends along a length of the elongate channel, wherein the distal end of each of the first and second legs is attached to the sealing flange; and a second base attached to the second pouch sidewall and having an elongate profile extending therefrom;

wherein the elongate profile extends into and releasably engages the channel through the slit when the elongate channel and the elongate profile are occluded.

10. The pouch of claim 9, wherein the sealing flange forms an airtight seal against the elongate profile.

11. The pouch of claim 10, wherein at least one of the first base the first leg or the second leg includes an aperture therethrough.

12. The pouch of claim 9, wherein the sealing flange is integral to the first pouch sidewall.

13. The pouch of claim 9, wherein the closure element and the second base are attached to the outer surfaces of the first and second pouch sidewalls, respectively.

14. The pouch of claim 9, wherein the sealing flange comprises a layer made of a polyolefin plastomer.

15. The pouch of claim 9 further comprising a one-way valve disposed in or on at least one of the first and second pouch sidewalls or an edge thereof and a textured portion along the length of the elongate profile to provide tactile and/or audible sensations when the elongate channel and the elongate profile are occluded.

16. A pouch, comprising:

first and second pouch sidewalls, each having respective outer and inner surfaces and attached to one another to define a mouth between the respective inner surfaces thereof;

a first closure element comprising an elongate channel having first and second spaced apart legs extending from a first base having an aperture extending therethrough between the legs;

a sealing flange attached to and extending between the first and second spaced apart legs and having a slit therethrough that extends along a length of the elongate channel; and a second closure element attached to the second pouch sidewall and comprising an elongate profile extending from a second base;

wherein the first and second spaced apart legs are attached at a respective distal end thereof to the sealing flange, and the elongate profile forms an airtight seal with the sealing flange when the first and second closure elements are in an occluded statue, wherein the first and second closure elements are attached to the outer surfaces of the first and second pouch sidewalls, respectively, and wherein the sealing flange is integral to the first pouch sidewall.

17. The pouch of claim 16, wherein the sealing flange comprises a layer made of a polyolefin plastomer.

* * * * *